US010894659B2

(12) United States Patent
Geiger et al.

(10) Patent No.: US 10,894,659 B2
(45) Date of Patent: Jan. 19, 2021

(54) LID CUTOUT WITH DISPERSING SHOWER EFFECT

(71) Applicant: PicoBrew, Inc., Seattle, WA (US)

(72) Inventors: Avi R. Geiger, Seattle, WA (US); Matthew J. Walsh, Seattle, WA (US)

(73) Assignee: PB Funding Group, LLC, Bellevue, WA (US)

( * ) Notice: Subject to any disclaimer, the term of this patent is extended or adjusted under 35 U.S.C. 154(b) by 24 days.

(21) Appl. No.: 16/190,193

(22) Filed: Nov. 14, 2018

(65) Prior Publication Data

US 2020/0148463 A1 May 14, 2020

(51) Int. Cl.
*B65D 85/804* (2006.01)
*B65D 43/14* (2006.01)

(52) U.S. Cl.
CPC ..... *B65D 85/8043* (2013.01); *B65D 43/14* (2013.01)

(58) Field of Classification Search
CPC ..... B65D 85/8043; B65D 43/14; B65D 2081/007; B65D 47/2031
USPC ..... 220/229
See application file for complete search history.

(56) References Cited

U.S. PATENT DOCUMENTS

2013/0064936 A1* 3/2013 Meelker ..... B65D 85/8043 426/112
2013/0247774 A1* 9/2013 Macchiavelli ..... B65D 85/8043 99/295
2016/0137401 A1* 5/2016 Heydel ..... B65D 85/8043 426/115

* cited by examiner

*Primary Examiner* — King M Chu
(74) *Attorney, Agent, or Firm* — Krajec Patent Offices, LLC; Russell Krajec

(57) ABSTRACT

A lid to a consumable container may have a cutout pattern that may open when impinged by a water or other liquid stream. The liquid stream may cause the cutout pattern to flex and in some cases rotate, thereby exposing gaps between elements through which liquid may disperse into the container. The container may be made from a pulp material, such as thermoformed bagasse pulp, and the cutout pattern may be made with a laser or stamp. The pattern may have various flexible elements, which may be defined by through or partially cut areas which may separate, as well as hinge areas which may be uncut or partially cut. The cutout pattern may have closed position prior to use, where ingredients in the container may be trapped, and may have an open position created when liquid impinges on the pattern, thereby opening the pattern and allowing liquid to be dispersed in a shower effect.

35 Claims, 3 Drawing Sheets

200 CUT OUT DESIGN

LID CUTOUT WITH DISPERSING SHOWER EFFECT

BACKGROUND

Food processing equipment, among other devices, may introduce liquid into various packages for processing. For example, a coffee maker may introduce hot water into a package in order to make coffee. The packaging may be designed to hold a product, such as ground coffee in the example, yet may be punctured or otherwise opened to introduce hot water to come in contact with the ingredient.

SUMMARY

A lid to a consumable container may have a cutout pattern that may open when impinged by a water or other liquid stream. The liquid stream may cause the cutout pattern to flex and in some cases rotate, thereby exposing gaps between elements through which liquid may disperse into the container. The container may be made from a pulp material, such as thermoformed bagasse pulp, and the cutout pattern may be made with a laser or stamp. The pattern may have various flexible elements, which may be defined by through or partially cut areas which may separate, as well as hinge areas which may be uncut or partially cut. The cutout pattern may have closed position prior to use, where ingredients in the container may be trapped, and may have an open position created when liquid impinges on the pattern, thereby opening the pattern and allowing liquid to be dispersed in a shower effect.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Lid Cutout with Dispersing Shower Effect

A container lid may have a cutout pattern that may open when impinged by a water or other liquid stream. The pattern may have several flexible elements that may cause the cutout pattern to open up and disperse the liquid into a container. The pattern may be made by laser cutting, die cutting, or some other manufacturing process, and may be a low cost but effective way to seal a container yet allow the container to be used in a machine to process ingredients in the container.

A typical use case for a cutout pattern may be in a disposable or even compostable container for food ingredients. The container may have dry ingredients which may be mixed with water, and an example use case may be for a container of coffee grounds which may receive a stream of hot water for extracting the coffee.

The cutout pattern may be arranged in an approximate spiral arrangement of flexible elements. In some cases, the flexible elements may be attached to a center element. An approximate spiral design may cause the cutout pattern to rotate during opening, thereby exposing gaps between the flexible elements through which liquid may flow. The gaps or openings may direct liquid to spray within a container in a shower-like effect, where the liquid may be dispersed throughout the container.

Some cutout patterns may not have an approximate spiral arrangement, and may operate by having some elements that may flex in a manner that the elements may separate and allow liquid to be dispersed inside a container.

Figure 1:
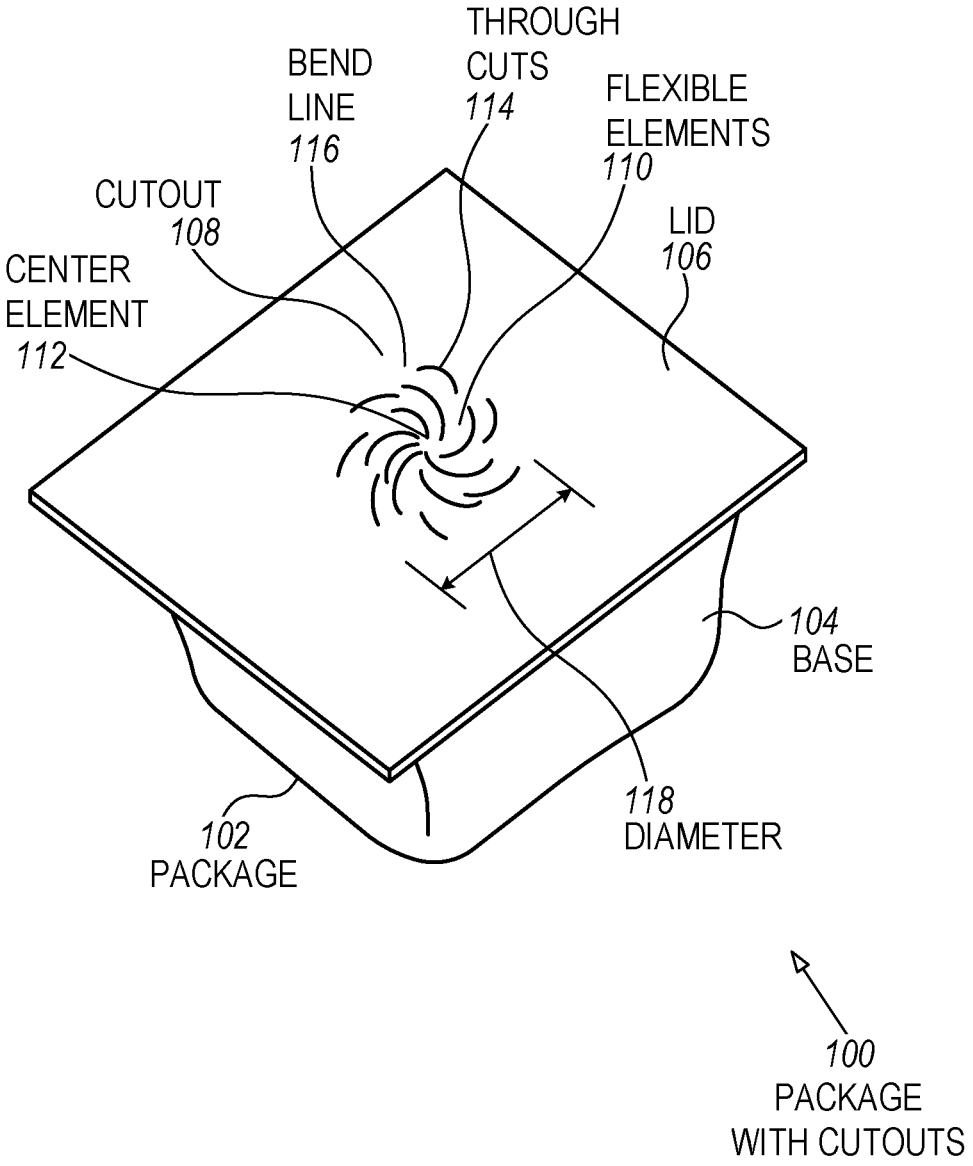
FIG. 1 is a diagram illustration of an embodiment showing a consumable package with a cutout for introducing liquid into the package. The illustration is not to scale.

A container lid may be manufactured from a pulp material, such as a thermoformed bagasse pulp. One such example may have a base material that may be between 0.4 and 1.5 mm. A cutout pattern may be approximately between 10 and 25 mm in diameter. A liquid stream capable of opening the cutout pattern may be between 0.25 and 2.0 l/min, emanating from an orifice of 0.7 and 3.25 mm. Such an example may cause a cutout pattern to open approximately 1 to 3 mm or more, FIG. 1 is a diagram illustration of an embodiment 100 showing a package with a cutout. The package 102 may have a base 104 and a lid 106, and may contain a dry ingredient that may be mixed with water or other liquid during a manufacturing process. An example process may be brewing coffee, tea, or other beverage, where a stream of water may be directed at the cutout 108. The figure is not to scale.

The cutout 108 may expand from a closed position as illustrated to an open position such that liquid may be dispersed into the package 102. The cutout 108 may open up such that gaps or openings may form between the various flexible elements 110, thereby allowing liquid to be introduced into the package 102.

The cutout 108 may have several flexible elements 110 which may be connected to a center element 112. The flexible elements 110 may be defined by various through cuts 114 and bend lines 116. The through cuts 114 may separate, thereby opening a gap through which liquid may flow, while the bend lines 116 may remain connected between the various elements or the main body of the lid 106.

In many cases, the through cuts 114 and bend lines 116 may be created by laser cutting, stamping, or some other process. In some cases, the cutout 108 may be formed into the base material at the time the base material may be constructed, such as by forming the features of the cutout 108 into the base material when forming a pulp-based container.

In many cases, the through cuts 114 may be cut all the way through the material of the lid 106, while in other cases, the through cuts 114 may be cut partially through the material, but may be designed to separate when liquid may be introduced.

Many embodiments may have a pulp material base, which, when wetted, may become more pliable and soft. The wetted material may allow a partially cut line to separate and open up, thereby forming the through cuts 114.

Similarly, some of the bend lines 116 may or may not be cut into the material of the lid 106. The bend lines 116 may be designed to flex or bend when the cutout changes to an open position. In some cases, various bend lines 116 may be formed with a depression, indentation, partial cut, or some other relief by which a bend may occur, but without having the base material separate at a bend line 116.

The cutout 108 may be defined by a diameter 118, which may be the outer limits of the cutout 108. The diameter 118 may be selected to be a multiple of the size of an incoming liquid stream. For example, one useful configuration may be to have the diameter 118 to be 8 or more times the size of an incoming liquid stream. Such a size of the cutout 108 may be large enough such that the force of the incoming water stream may cause the elements of the cutout 108 to flex and allow liquid to pass through the lid 106 and into the base 104.

The larger the ratio between the diameter of the incoming liquid stream and the cutout diameter 118, the less force may be required to cause the cutout 108 to open, and such a larger ratio may be useful in cases where less force may be available from the incoming water stream. In such cases, the ratio of cutout diameter 118 and incoming liquid stream diameter may be 10, 15, 20, or more.

The ratio of diameter 118 to the impinging liquid stream may be increased based on the accuracy or tolerance of a machine in which the package 102 may be placed. Where the package 102 may be loosely placed, such that the package 102 may move laterally within a holding area, the diameter 118 may be increased to compensate for the inconsistencies between where a liquid stream may impinge the cutout 108.

Figure 2:
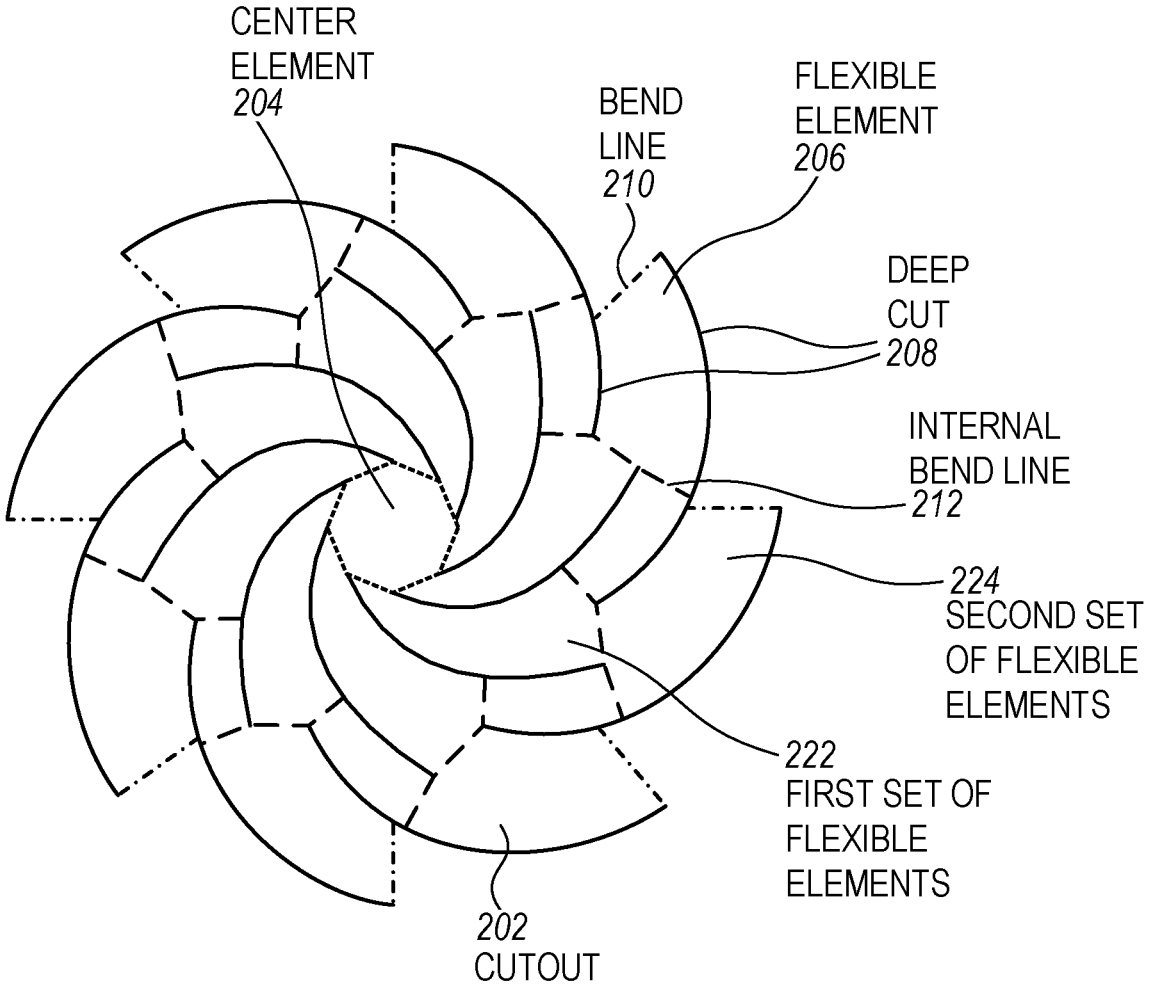
FIG. 2 is a diagram illustration of an embodiment showing an example of a spiral shaped cutout. The illustration is to scale.
Figure 2:
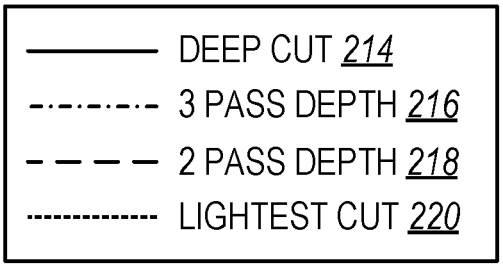

FIG. 2 is a diagram illustration of an embodiment 200 showing an example cutout design. The cutout 202 may be illustrated with three different depths of cuts, and may have a center element 204 attached to several flexible elements 206. The flexible element 206 may be defined by deep cuts 208 and bend lines 210 and 212. The internal bend line 212 may be deeper than the external bend line 210. The figure is approximately to scale.

The cutout 202 may operate by opening and twisting slightly when a liquid stream impinges on or near the center element 204. The twisting action may open gaps between the flexible elements along the deep cuts 208, while allowing the flexible elements to bend at the bend lines 210 and 212.

The cutout 202 may create a circular, distributed shower pattern of liquid. When used in a package, the cutout 202 may spread liquid through the package, thereby evenly distributing the liquid.

In the example of embodiment 200, the lines illustrated with a solid line 214 may be through cuts or deep cuts that may separate when liquid impinges on the cutout 202. The lines illustrated with the three pass dash line 216 may be bend lines created with three laser passes, which may be deeper than two pass dash line 218, which may in turn be deeper than single pass dash line 220.

The different depths of cuts may be used to control how much flexibility or bending that may occur with a specific design. In many cases, a design may be tested and when a bend line fails and separates, a designer may strengthen the bend line by using a bend line with more material. Such a bend line may use less power from a laser, fewer passes by a laser, or less indentation when using a press or stamping operation.

The cutout 202 may represent an example of a radial design, where flexible elements 206 may form a spiral away from a center element 204. Such a design may have an effect of rotating between a closed and open position. The example of cutout 202 may have a first set of flexible elements 222, which may be connected to the center element 204, followed by a second set of flexible elements 224 connected to the first set of flexible elements 222. The effect of stacking such elements together may increase the depth of opening and allow more liquid to flow through the cutout 202.

The cutout 202 may have a closed position as illustrated, where ingredients contained in a package may be prevented from leaving the package. When water or liquid may be driven at the cutout 202, the force of the liquid may cause the cutout 202 to depress, thereby opening up holes between the flexible elements and allowing liquid to pass through.

Figure 3:
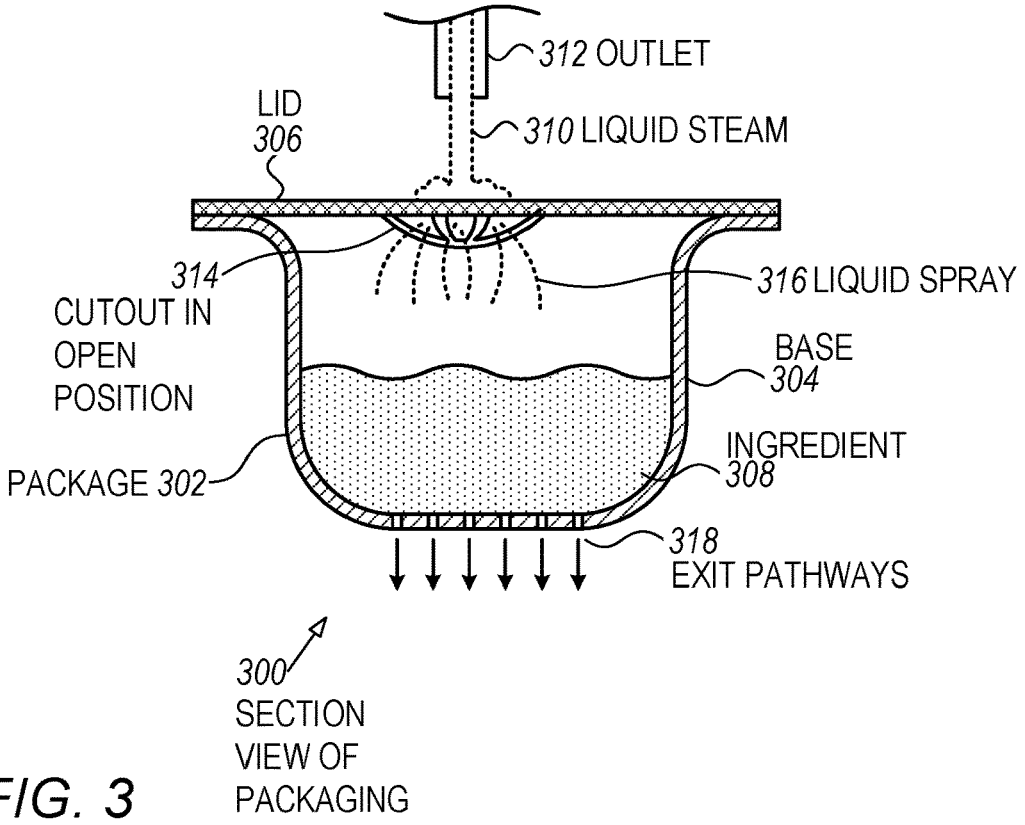
FIG. 3 is a cross-sectional diagram illustration of an embodiment of a package with water passing through and a cutout in an open position. The illustration is not to scale.

FIG. 3 is a cutaway illustration of an embodiment 300 showing a package 302 with liquid flowing through the package. The figure is not to scale.

The package 302 may have a base 304 and a lid 306. The base 304 and lid 306 may be joined by glue, mechanical fastening, stitching, or any other joining mechanism. The shape of the base 304 and lid 306 may be one example of a package that may be produced using thermoformed plastic, formed metal sheet, pulp material, or any other base material.

The ingredient 308 may be contained in the package 302 during assembly and transport. When the package 302 may be placed in a processing machine, such as a coffee or other beverage machine, a liquid stream 310 may be directed at the cutout 314 through a nozzle or outlet 312. The cutout 314 may be illustrated in an open position, where the center element of a cutout may be pushed downward by the liquid stream 310, thereby causing a liquid spray 316.

The liquid spray 316 may act like a showerhead, directing liquid throughout the base 304 and causing the ingredient 308 to be uniformly wetted. The liquid may pass through exit pathways 318 cut in the bottom of the base 304.

Some situations and ingredients may attempt to have a long contact time between the liquid and the ingredient 308. In such situations, the exit pathways 318 may be configured to restrict liquid flow such that liquid may accumulate inside the base 304. Other situations may have less contact time desired and may have larger openings for the exit pathways 318, thereby allowing the liquid to quickly leave the package 302.

The exit pathways 318 may be slots, cutouts, or other openings through which liquid may pass. In some cases, the exit pathways 318 may have a screen, mesh, or other components that may be placed over an opening and secured in place. In one design, an ingredient 308 may be placed in a sachet, such as a tea bag, which may allow liquid to pass in and out of the sachet. The sachet may rest over an opening in the bottom of the base 304, thereby operating as a mechanical screen or filter to retain the ingredient 308 while letting liquid pass through the package.

One example embodiment may use a thermoformed bagasse pulp container with a thickness of 0.6 mm, but acceptable results have been seen with a range of 0.4 to 1.5 mm. An outlet or nozzle diameter of 2.6 mm and a liquid flow rate of 1.5 L/min has shown good results with a cutout similar to embodiment 200 and a diameter of approximately 23 mm. Acceptable results have been observed with nozzle diameters of 1.5 to 4 mm, and flow rates of 0.25 to 5 L/min.

Figure 4:
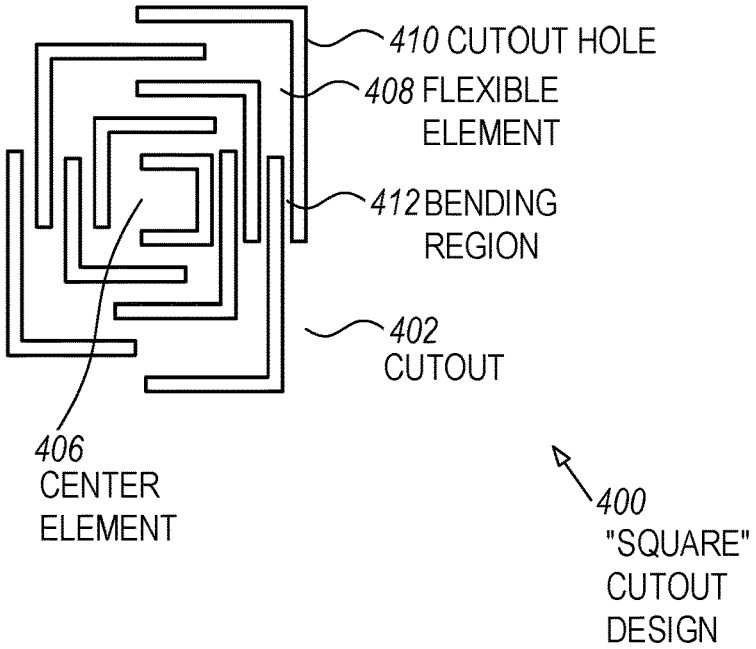
FIG. 4 is a diagram illustration of an embodiment showing an example of a rectangular shaped cutout. The illustration is approximately to scale.

FIG. 4 is an example embodiment 400 showing a square cutout 402. The square cutout 402 may be an example of another design which has shown to be effective. The design may have a center element 406 connected to several flexible elements 408. The flexible elements 408 may be defined by a cutout hole 410 and a bending region 412.

Embodiment 400 may open by the bending region 412 flexing such that each flexible element opens with respect to the neighboring flexible element. The shower effect of the elements may distribute liquid throughout a package in a different pattern than embodiment 200, but with similar effectiveness.

The foregoing description of the subject matter has been presented for purposes of illustration and description. It is not intended to be exhaustive or to limit the subject matter to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. A container lid comprising:

a base material;

a cutout pattern in said base material, said cutout pattern comprising:

a plurality of flexible elements adapted to have an open position and a closed position;

said open position being caused in response to a liquid stream impinging on said plurality of flexible elements;

a center element, at least one of said plurality of flexible elements being attached to said center element;

at least a portion of said plurality of flexible elements being arranged in an approximate spiral relationship around said center element.

2. The container lid of claim 1, said cutout pattern having a diameter, said open position being a deflection from said closed position by at least 1/16 of said diameter.

3. The container lid of claim 2, said base material being a pulp material.

4. The container lid of claim 3, said cutout pattern being manufactured by laser etching.

5. The container lid of claim 3, said cutout pattern being manufactured by stamping.

6. The container lid of claim 3, said diameter being between 10 mm and 25 mm.

7. The container lid of claim 6, said liquid stream being between 0.25 and 2.0 l/min.

8. The container lid of claim 7, said liquid stream being produced from an opening diameter between 0.7 and 3.25 mm.

9. The container lid of claim 8, said base material being thermoformed bagasse pulp.

10. The container lid of claim 9, said base material having a thickness between 0.4 and 1.5 mm.

11. The container lid of claim 2, at least some of said flexible elements having a length to width ratio of at least 3:1.

12. The container lid of claim 2, said flexible elements being defined in part by a score line.

13. The container lid of claim 12, said score line being comprising an impression less than 50% of thickness of said base material.

14. The container lid of claim 13, said score line defining a bending location.

15. The container lid of claim 2, said flexible elements being defined by a separation line and a bending area.

16. The container lid of claim 15, said separation line of a first flexible element being at least partially attached to a second flexible element.

17. The container lid of claim 16, said separation line being adapted to separate when said liquid stream impinges on said first flexible element.

18. The container lid of claim 15, said bending area being defined by a score line, said separation line being having a first depth being greater than a second depth of said score line.

19. A container lid comprising:

a base material;

a cutout pattern in said base material, said cutout pattern comprising:

a plurality of flexible elements adapted to have an open position and a closed position;

said open position being caused in response to a liquid stream impinging on said plurality of flexible elements;

said cutout pattern having a diameter, said open position being a deflection from said closed position by at least 1/16 of said diameter.

20. The container lid of claim 19, said base material being a pulp material.

21. The container lid of claim 20, said cutout pattern being manufactured by laser etching.

22. The container lid of claim 20, said cutout pattern being manufactured by stamping.

23. The container lid of claim 19, said diameter being between 10 mm and 25 mm.

24. The container lid of claim 23, said liquid stream being between 0.25 and 2.0 l/min.

25. The container lid of claim 24, said liquid stream being produced from an opening diameter between 0.7 and 3.25 mm.

26. The container lid of claim 19, said base material being thermoformed bagasse pulp.

27. The container lid of claim 26, said base material having a thickness between 0.4 and 1.5 mm.

28. The container lid of claim 19, at least some of said flexible elements having a length to width ratio of at least 3:1.

29. The container lid of claim 19, said flexible elements being defined in part by a score line.

30. The container lid of claim 29, said score line being comprising an impression less than 50% of thickness of said base material.

31. The container lid of claim 30, said score line defining a bending location.

32. The container lid of claim 19, said flexible elements being defined by a separation line and a bending area.

33. The container lid of claim 32, said separation line of a first flexible element being at least partially attached to a second flexible element.

34. The container lid of claim 33, said separation line being adapted to separate when said liquid stream impinges on said first flexible element.

35. The container lid of claim 32, said bending area being defined by a score line, said separation line being having a first depth being greater than a second depth of said score line.

* * * * *